US005600972A

United States Patent [19]

Magi et al.

[11] Patent Number: 5,600,972

[45] Date of Patent: Feb. 11, 1997

[54] ANNULAR PIECE OF JEWELRY, SUCH AS A RING, WITH AT LEAST TWO COUPLED ANNULAR ELEMENTS

[75] Inventors: Raffaello Magi, Arezzo; Rosanna Natale, Chieti, both of Italy

[73] Assignee: Unoaaeerre Italia S.p.A., Arezzo, Italy

[21] Appl. No.: 578,087

[22] Filed: Dec. 27, 1995

[30] Foreign Application Priority Data

Jan. 4, 1995 [IT] Italy ..... FI95A0002

[51] Int. Cl.[6] ..... A44C 9/00

[52] U.S. Cl. ..... 63/15.1; 63/15.3; 63/15.4

[58] Field of Search ..... 63/15, 15.1, 15.3, 63/15.4; D11/28, 34, 35

[56] References Cited

U.S. PATENT DOCUMENTS

| | | | |
|---|---|---|---|
| 984,803 | 2/1911 | Dinuccio | 63/15.3 |
| 1,936,604 | 11/1933 | Moldenhauer . | |
| 1,972,128 | 9/1934 | Bobbroff . | |
| 4,226,094 | 10/1980 | Wolpoff | 63/15.4 |

FOREIGN PATENT DOCUMENTS

| | | |
|---|---|---|
| 0842140 | 2/1939 | France . |
| 9209295 | 10/1992 | Germany . |
| 9301623 | 1/1993 | Germany . |
| 1164843 | 9/1969 | United Kingdom . |

*Primary Examiner*—Kien T. Nguyen

*Attorney, Agent, or Firm*—Hopgood, Calimafde, Kalil & Judlowe

[57] ABSTRACT

Two annular elements (1, 5) are coupled so as to be slightly inclined in relation to one another and one inside the other, the internal annular element (1) has two external depressions (3) which are virtually diametrically opposite and essentially inclined in a symmetrical manner in relation to a diametral plane, for receiving and retaining the external annular element (5).

10 Claims, 2 Drawing Sheets

ANNULAR PIECE OF JEWELRY, SUCH AS A RING, WITH AT LEAST TWO COUPLED ANNULAR ELEMENTS

DESCRIPTION

The invention relates to a piece of jewelry of particular shape which is capable of easy assembly of a number of components with the possibility of obtaining many combinations, being easy to produce also. These and other aims and advantages will become clear from the text which follows.

Essentially, the abovementioned annular piece of jewelry—such as a ring or the like—comprises at least two coupled annular elements, which are slightly inclined in relation to one another and one inside the other; the internal annular element has two external depressions which are virtually diametrically opposite and essentially inclined in a symmetrical manner in relation to a diametral plane; said depressions define a seat in which the external annular element is received, which is located and retained there in an inclined lying position in relation to the internal annular element.

The bottom of the depressions is constituted by a surface essentially derived by tooling, and the internal surface of each of the annular elements is slightly bellied, that is to say with a slightly convex cross-section and with accentuated convexity at the ends.

The external annular element can be fixed or retained only by the sides of the depressions, and is therefore demountable. Said external annular element can be divided in two.

The annular elements can have convex surfaces of revolution externally.

The external surface of at least one of the annular elements can be worked or somehow decorated, also with appliqué, with set components or otherwise.

The inclination between the two annular elements can be different, but is usually defined by the width of the external annular element; to ensure that in the two zones furthest from the depressions the two elements do not leave space between them.

At least one of the annular elements—preferably the external one—will be slightly deformable in an elastic manner to facilitate mounting and also any demounting.

The invention will be better understood by following the description and attached drawing, which shows a non-limiting exemplary embodiment of the invention itself and in which FIG. 1 shows a lateral view and partial section along the line I—I in FIG. 4;

Figure 1:
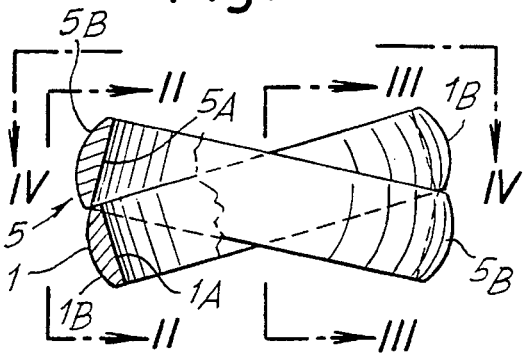
Figure 2:
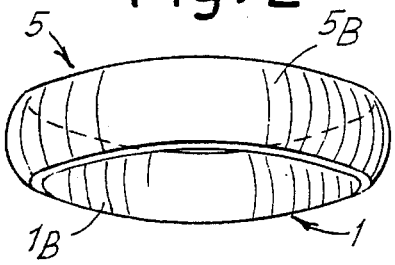
FIGS. 2 and 3 show a view and a section along the lines II—II and III—III in FIG. 1.
Figure 3:
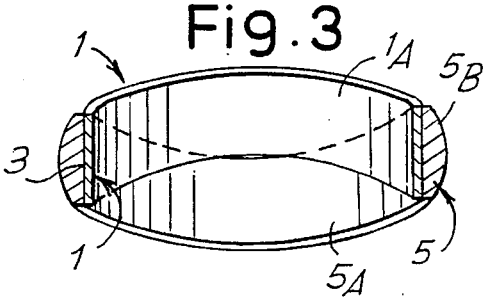
Figure 4:
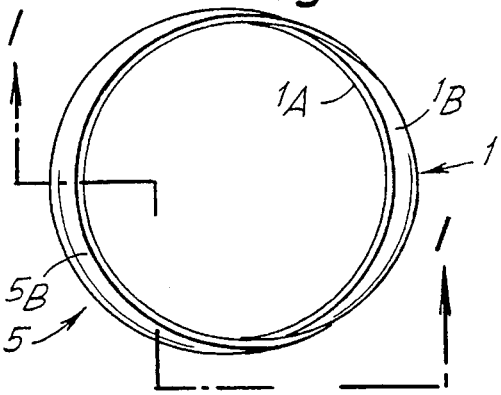
FIG. 4 is a plan view along the line IV—IV in FIG. 1.
Figure 5:
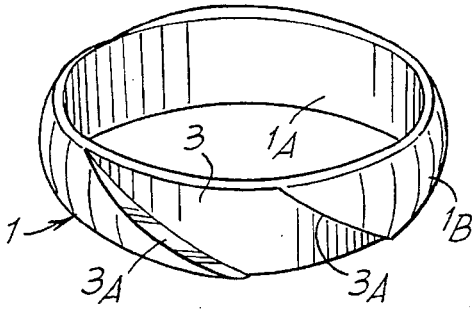
FIG. 5 shows a perspective view of the internal annular element.
Figure 7:
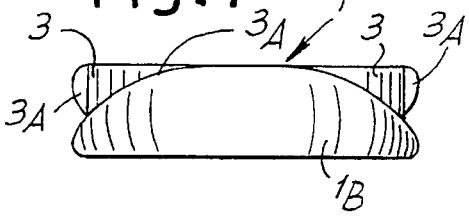
FIGS. 7 and 8 show views along the lines VII—VII and VIII—VIII in FIG. 6.
Figure 6:
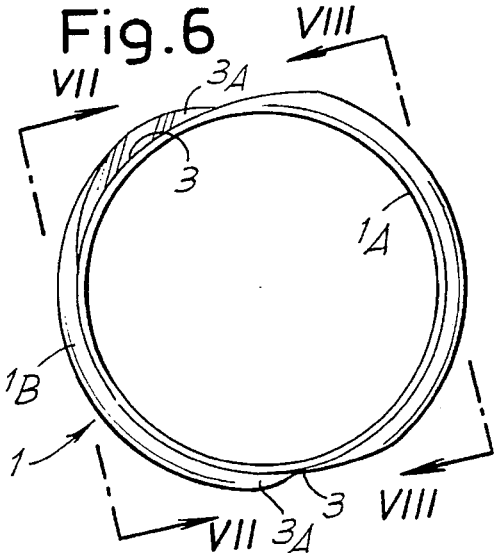
FIG. 6 shows a plan view along the line VI—VI in FIG. 5 of said internal annular element.
Figure 8:
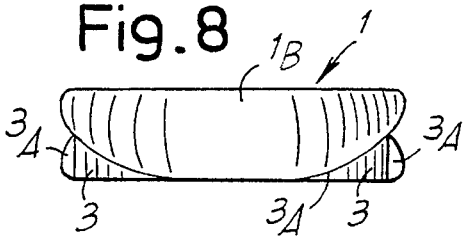
Figure 9:
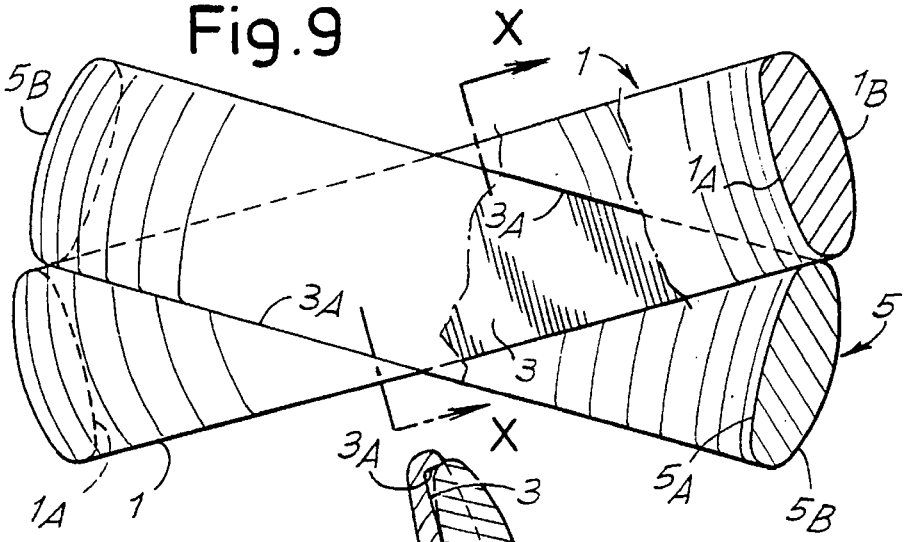
FIGS. 9 and 10 show an enlarged assembly and a section along X—X in FIG. 9.
Figure 10:
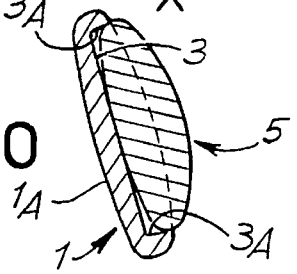

According to what is illustrated in FIGS. 1 to 10 of the attached drawing, 1 indicates an internal annular element, illustrated in particular in FIGS. 5 and 6, which has a bright internal surface 1A which is cylindrical or slightly bellied (that is to say convex in cross-section, as can be seen in particular in FIG. 10), and an external surface 1B which—in the execution illustrated in FIGS. 1 to 9—has the shape of a portion of surface which is approximately toroidal with curved connections. Characteristically, said internal annular element 1 has, in approximately diametrically opposite positions, two depressions which are essentially inclined in a symmetrical manner and each delimited by a tooled, essentially cylindrical bottom surface 3 and by two sides 3A which are essentially orthogonal at the bottom, in cross-section, or with a cross-section which corresponds essentially to that of a second, external annular element to be described. The depressions 3, 3A are essentially parts of a circular shape with the two gradients inclined in opposite directions.

A second, external annular element 5 has a shape similar to the internal one 1 but without the inclined depressions such as 3, 3A; this external element 5 has an internal surface 5A which is also rolled bright, cylindrical or bellied, similar to 1A, and an external surface 5B which is made—in the example in FIGS. 1 to 8—with the shape of a portion of toroidal surface. One possible section of said second, external annular element 5 is illustrated in FIG. 9. The diametral dimensions of the external annular element 5 are equal to or slightly greater than those of the internal annular element 1, and are in any case such that the internal surface 5A of the external annular element 5 has complementary geometrical characteristics in relation to those of the depressions 3, 3A opposite of the internal annular element 1. The arrangement is such that the two annular elements 1 and 5 can be coupled by being inclined in relation to one another, as can be seen clearly in the drawing, the external annular element 5 being located in the opposite inclined depressions 3, 3A which imparts the relative inclination of the element 5 in relation to the element. Mounting takes place easily by making use of the shapes of the two elements and the possibility, although limited, of elastic and/or plastic deformation of the two elements, 1 and 5, and in particular the elastic deformability of the external element 5, as a result of which, by compressing diametrally one element in one direction and/or the other in the orthogonal direction in the diametral or virtually diametral direction, the possibility is obtained of making the external annular element 5 exceed the differences in diameter between the bottom 3 and the external surface 1B of the internal element 1.

Mounting can take place extemporaneously with one or another of a number of different types of external elements so as to create a piece of jewelry of different shape and of different aesthetic appearance according to requirements, having available a range of external elements 5 to be applied to an internal annular element 1 or to one or other of a range of available internal elements 1. The piece of jewelry formed from an internal annular element and from one or more external annular elements can also be relatively easily demounted to modify the combination of the two annular elements such as 1 and 5 respectively to be able to use the two annular elements independently of one other and in particular to be able to use if necessary the external annular element 5. The external element 5, or one or all the external elements 5, can be fixed to the internal element 1 or can be capable of sliding in relation to this, within the depressions 3, 3A.

Figure 12:
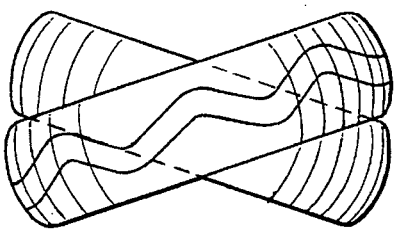
FIGS. 12, 13 and 14 show further exemplary embodiments.
Figure 13:
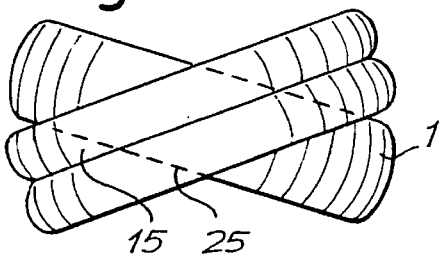
Figure 14:
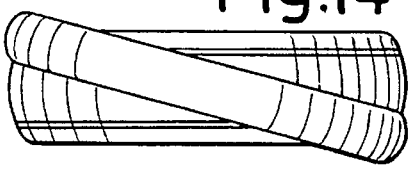

In FIGS. 12 to 14, possible non-limiting examples of pieces of jewelry formed from combined annular elements as already described with reference to FIGS. 1 to 10 are indicated. In particular one annular element and in particular an external annular element can also be double as indicated by 15 and 25 in FIG. 13, the two annular elements 15 and 25 being placed side by side and retained in the depressions 3, 3A of the annular element 1. The two different elements 15 and 25 can be worked on the surface in different ways and/or constituted by different materials. On the other hand, a single annular element such as 5 can be shaped to appear like two elements aesthetically similar to the pair of elements 15 and 25 although not independent of one another.

Figure 11:
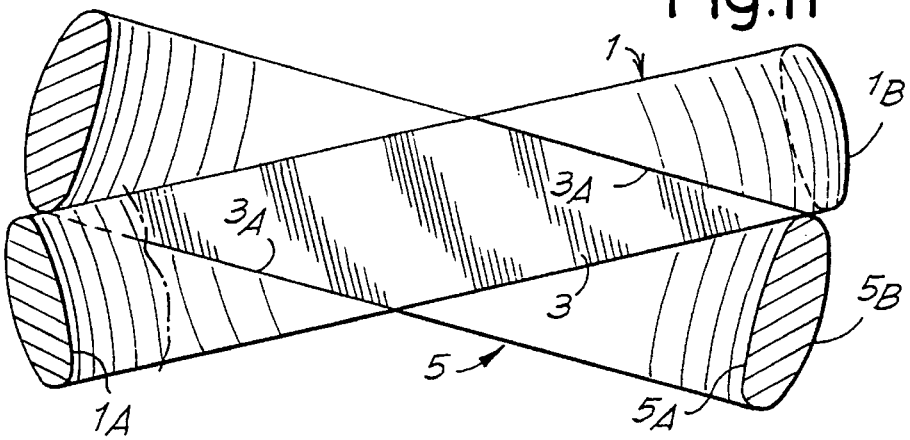
FIG. 11 shows a view similar to that in FIG. 9, in which the external annular element is narrower and less inclined in relation to the execution in FIG. 9.

FIG. 11 shows a solution in which—in comparison with FIG. 9—the possibility exists of imposing a different relative inclination between the two annular elements that is to say of varying the angle formed by the median planes of lying of the two annular elements, by means of morphological modification and modification of the inclination of the depressions 3, by modifying the width of the internal and external annular elements, or at least of the external one. One and the same external annular element (single or double or multiple) can be adapted to one or other of a plurality of internal annular elements 1 which have opposite and symmetrical depressions 3 which have a different inclination.

It appears convenient, in any case, to make the inclined depressions 3, 3A and the dimensions of the internal and external annular element(s) so as not to have free space between the internal and external annular element(s) in the zones of intersection with the plane of essential symmetry.

It is understood that the drawing shows only an example given only as a practical demonstration of the invention, it being possible for this invention to vary in form and arrangement without however leaving the scope of the concept which informs the invention itself. The presence if any of reference numbers in the enclosed claims has the aim of facilitating reading of the claims with reference to the description and to the drawing, and does not limit the scope of protection represented by the claims.

We claim:

1. An annular piece of jewelry, which comprises at least two coupled annular elements, which are slightly inclined in relation to one another and one inside the other, the internal annular element having two external depressions which are virtually diametrically opposite and essentially inclined in a symmetrical manner in relation to a diametral plane, said depressions defining a seat for receiving and positioning the external annular element which is located and retained there in an inclined lying position in relation to the internal annular element.

2. The piece of jewelry as claimed in claim 1, wherein the bottom of the depressions are constituted by a tooled surface and the internal surface of each of the annular elements is slightly bellied in cross-section.

3. The piece of jewelry as claimed in claim 1, wherein the external annular element is divided in two.

4. The piece of jewelry as claimed in claim 1, wherein the annular elements have convex surfaces of revolution externally.

5. The piece of jewelry as claimed in claim 1, wherein the external surface of at least one of the annular elements is selected from the group of surfaces consisting of smooth, bright, worked, decorated appliqué, and with a set of affixed components.

6. The piece of jewelry as claimed in claim 1, wherein the external annular element is inclined in relation to the internal annular element, according to its own width.

7. The piece of jewelry as claimed in claim 1, wherein at least one of the annular elements is slightly deformable in an elastic or plastic manner to facilitate mounting.

8. The piece of jewelry as claimed in claim 7, wherein the deformable annular element is the external element.

9. The piece of jewelry as claimed in claim 1, wherein the external annular element is of a diameter which is slightly greater than the corresponding diameter of the internal element.

10. The piece of jewelry as claimed in claim 1, wherein the two or more annular elements are independently slidable.

* * * * *